US005971837A

United States Patent [19]

McDavid

[11] Patent Number: 5,971,837

[45] Date of Patent: Oct. 26, 1999

[54] BARREL-SHAPED ABRASIVE BLASTING CABINET

[76] Inventor: Michael J. McDavid, Rte. 1, Box 184-C, Buchanan Dam, Tex. 78609

[21] Appl. No.: 09/121,665

[22] Filed: Jul. 23, 1998

Related U.S. Application Data

[63] Continuation-in-part of application No. 08/818,728, Mar. 14, 1997, abandoned.

[60] Provisional application No. 60/017,368, May 10, 1996.

[51] Int. Cl.[6] ..... B24C 9/00

[52] U.S. Cl. ..... 451/89; 451/87; 451/456; 451/38

[58] Field of Search ..... 451/87–89, 38–39, 451/456, 453

[56] References Cited

U.S. PATENT DOCUMENTS

| | | | |
|---|---|---|---|
| 3,300,902 | 1/1967 | Dockery | 451/89 |
| 3,805,453 | 4/1974 | Schmall | 451/89 |
| 3,906,674 | 9/1975 | Stone | 451/89 |
| 5,460,564 | 10/1995 | Bowes et al. | 451/89 |

*Primary Examiner*—Robert A. Rose
*Assistant Examiner*—George Nguyen
*Attorney, Agent, or Firm*—James H. Meadows

[57] ABSTRACT

A blasting cabinet for use in cleaning a workpiece with a dry abrasive has a horizontally arranged cylindrical housing, a hopper affixed to the lower sidewall of the housing, openings provided in the sidewall through which a user can insert his hands and can view the interior of the housing, a door at one end which covers a portion of one end of the housing, and means for establishing a lateral airflow through the housing. The blasting cabinet can also be equipped with a blasting means, such as a nozzle and associated hoses, which draws the abrasive from the hopper under a vacuum and subjects it to elevated pressure, which is then directed to the workpiece. Preferably, a retaining means is provided on the door, such as with a metal strip and external latch. Preferably, a grate for supporting the workpiece is provided inside the housing.

12 Claims, 4 Drawing Sheets

BARREL-SHAPED ABRASIVE BLASTING CABINET

REFERENCE TO RELATED APPLICATIONS

The present application is a continuation-in-part of U.S. Ser. No. 08/818,728, filed Mar. 14, 1997, now abandoned which claims priority of Provisional application 60/017,368, filed May 10, 1996.

TECHNICAL FIELD

The present invention relates to blasting cabinets that can be used in the high pressure cleaning of articles of manufacture with a dry abrasive.

BACKGROUND OF THE INVENTION

Cabinets for use in cleaning workpieces of paint, corrosion and other foreign debris have been available for many years. One type of cabinet used in these operations is a so-called blasting cabinet, in which an abrasive, e.g., sand, glass, and the like, is accelerated to a high velocity with a compressed gas, and is directed against the surface of the workpiece.

Representative of many previous blasting cabinets is that disclosed by U.S. Pat. No. 5,460,564. This bench-top cabinet is constructed from several flat panels, which are assembled together in a roughly rectangular shape, e.g., by numerous rivets or welding. A canted window panel is provided. This and similar approaches to constructing the working chamber of the blasting cabinet greatly, and needlessly, increase the cost of the cabinet.

A product-finishing apparatus having roughly the shape of an egg standing on end is depicted in U.S. Pat. No. 4,098,033. It appears that in this device a workpiece is transferred to the interior of the apparatus by way of a top door hinged to the lower chamber of the device. Apparently, abrasion of the window in this cabinet is significant, which necessitates the use of a supply roll of plastic in the top of the cabinet to permit ready replacement of the window.

Another recurring problem associated with blasting cabinets is the buildup of fine dust due to the fragmentation of blasting agent and release of dust particles from the workpiece. This dust reduces visibility within the chamber. One approach to separating the dust particles from recyclable blasting agent is disclosed by U.S. Pat. No. 5,107,632. This device, which has a spherical-shaped cabinet, creates a vacuum with an active air current in the base of the cabinet, which reportedly pulls the dust from the dead-air space of the cabinet. However, this post-abrasion approach to removing the dust would appear to leave a significant level of air-borne dust in the workspace of the cabinet, which has not migrated to the base of the cabinet. The ability of the user to view the workpiece therein would be substantially impaired.

Previously available blasting cabinets have been designed without great regard for the cost of manufacture. This inevitably results in a cost to the consumer that is for many users unacceptably high. Abrasion of the window commonly provided in the blasting cabinet and the buildup of airborne dust in the cabinet are also recurring problems in previous cabinets. Accordingly, there is a need for an abrasive blasting cabinet that can be assembled at relatively low cost from readily available materials. The cabinet should also reduce abrasion to the window of the cabinet and reduce dust levels therein so as to improve visibility.

SUMMARY OF THE INVENTION

The present invention is a blasting cabinet for use with a dry abrasive that is raised to a high velocity under the pressure of a compressed gas and is directed against a workpiece provided in the cabinet. The blasting cabinet comprises a substantially cylindrical housing oriented horizontally and having opposing (circular) end regions. One of the ends is covered completely with an endplate, and the other end is partially covered with an endplate affixed to the housing. The remainder of the area not covered with an endplate is covered with a door. The housing is preferably supported above the ground by mounting it on a frame.

The lower sidewall of the cylindrical housing is joined to a hopper, which contains and collects abrasive particles used in the cabinet. Openings are also provided in the cylindrical housing through which a user can insert his hands to manipulate a workpiece inside. A transparent window, typically curved so as to conform to the shape of the cylinder, is also provided in the sidewall, which permits the user to view the workpiece while blasting it with abrasive. A means for establishing a lateral airflow through the housing is also provided, which flows substantially between the window and the center of the housing where the workpiece is being manipulated. The airflow removes fine dust particles that are too light to settle in the hopper and would otherwise obscure the user's vision.

The door for the blasting cabinet is preferably removable therefrom. It is provided with a retaining means, such as a metal strip riveted thereto, which engages with the inside of the partial endplate. A means for pressing against the outside of the door is also provided in order to press the door against the periphery of that end of the cylindrical housing. A grate can be provided interior the cylindrical housing, and is preferably hinged therein, which is used to support a workpiece therein.

The cabinet can also be provided with a blasting means inside the housing. The blasting means, e.g., a nozzle, is connected to a source of compressed air, which upon passing through the nozzle at a high velocity draws abrasive from the hopper through a siphon line. Abrasive ejected from the blasting means can be directed to the surface of the workpiece by ready manipulation of the user.

The cylindrical shape of the cabinet housing affords several advantages. Significantly, its curved shape serves to reflect abrasive particles back toward the blasting means and the workpiece when they are positioned along the central longitudinal axis of the housing. This serves to reduce the spread of particles within the housing, which reduces visibility, as well as increases the efficiency of blasting. The curved shape of the housing also permits the positioning of a window substantially above the workpiece, which serves to improve the viewing angle for the user since he can view the object from above rather than from the side where particles may be deflected. Further aiding in the improvement of visibility is provision of a lateral airflow passing between the window and the workpiece. The airflow serves to remove dust particles from the housing, which are too light to settle into the hopper or reflect back to the center of the housing.

DETAILED DESCRIPTION OF THE INVENTION

Figure 1:
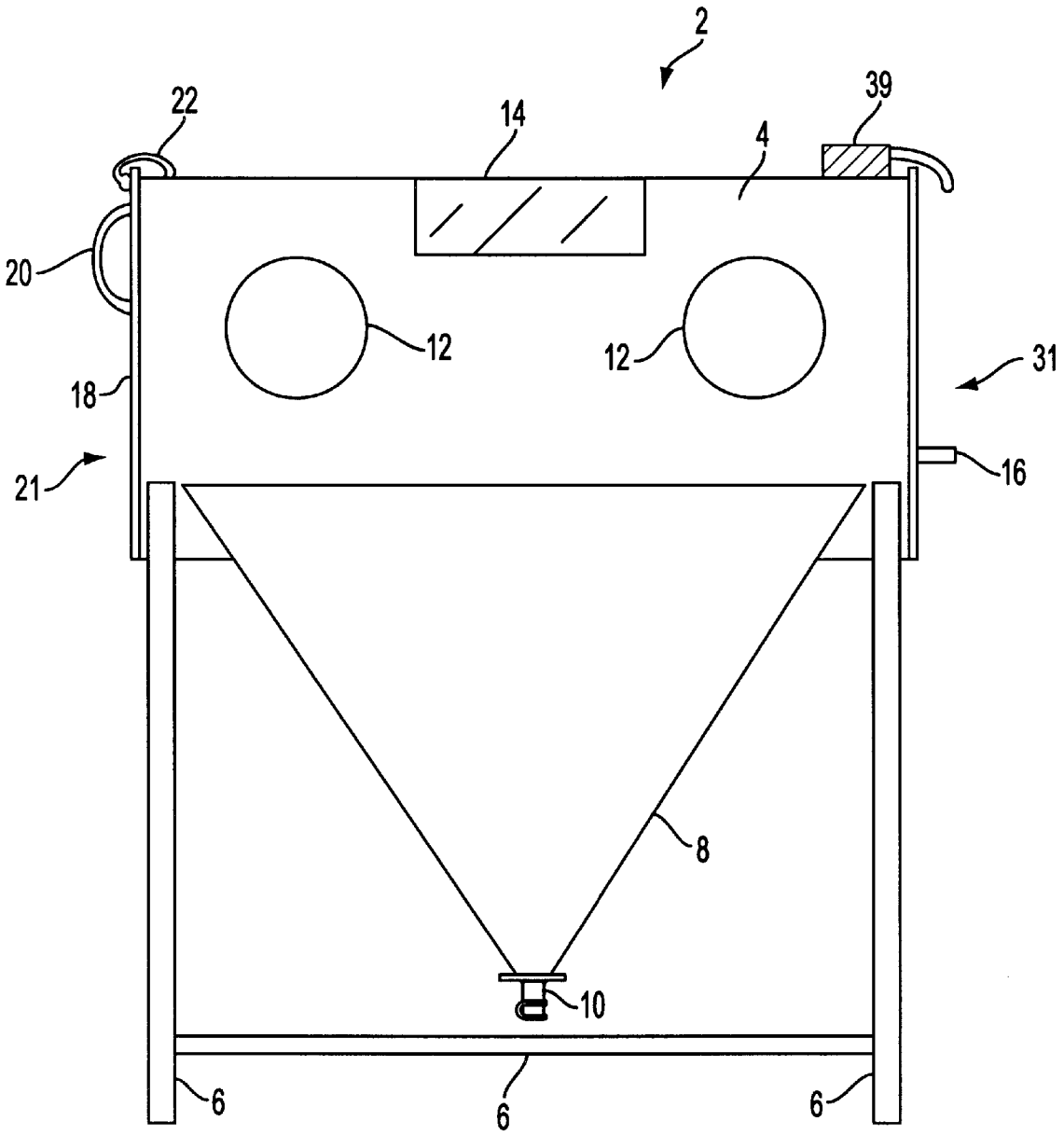
FIG. 1 depicts a perspective (side) view of a preferred blast cabinet according to the present invention.

The invention will now be described in more detail with reference to the figures. Referring to FIG. 1, cabinet 2 is constructed of a cylindrical housing 4, which is mounted on a support frame 6. A hopper 8 is provided at the lower side of cylinder 4 and is used to contain and collect abrasive. The hopper is provided with a drain 10 at its lower end, which can be sealed with a cap or plug. The plug is removable to permit convenient removal of abrasive.

Cylindrical housing 4 is conveniently provided by a barrel or drum, e.g., a 55 gallon drum. Preferred dimensions for the cylindrical region of the cabinet are about 34.5 inches in length and 23.5 inches in diameter.

To form cabinet 2, a lower section is removed from the sidewall of housing 4 and hopper 8 is attached to the periphery of the cut-away section, e.g., by welding. A plasma cutter (Hypertherm) is conveniently used to remove the section from the housing. The hopper can itself be conical in shape, i.e., frusto-conical. A preferred hopper shape, however, which permits abrasive to be collected from a greater area of the sidewall of cylinder is a rectangulo-pyramidal shape, in which flat triangular metal sheets are joined, as by welding, at their edges to form the hopper.

The flat panels used to form the hopper are truncated at their lower ends and a rectangular plate, e.g., 2"×2", is welded to the end of these panels. A threaded nipple is also installed onto which a screw cap is threaded, thereby forming drain cap 10.

Cylindrical housing 4 is further provided with armholes 12 in the side of the cylindrical housing through which a user's hands can be inserted. Also an opening is provided in the side of the housing so that a user can view the interior of the housing and a workpiece therein. These holes are conveniently provided in the housing with a plasma cutter. The view opening is provided with a window 14, which is preferably made of a transparent plastic sheet. A particularly preferred plastic material is polycarbonate, e.g., ⅛ inch in thickness, which has the durability and flexibility needed to conform to the housing. The plastic sheet is preferably attached to housing 4 with self-tapping sheet metal screws. A compressed gas inlet coupling 16 is also provided to the housing 4, preferably at an end of the housing, and provides entry of compressed air for operation of a blasting nozzle inside the housing.

Figure 2A:
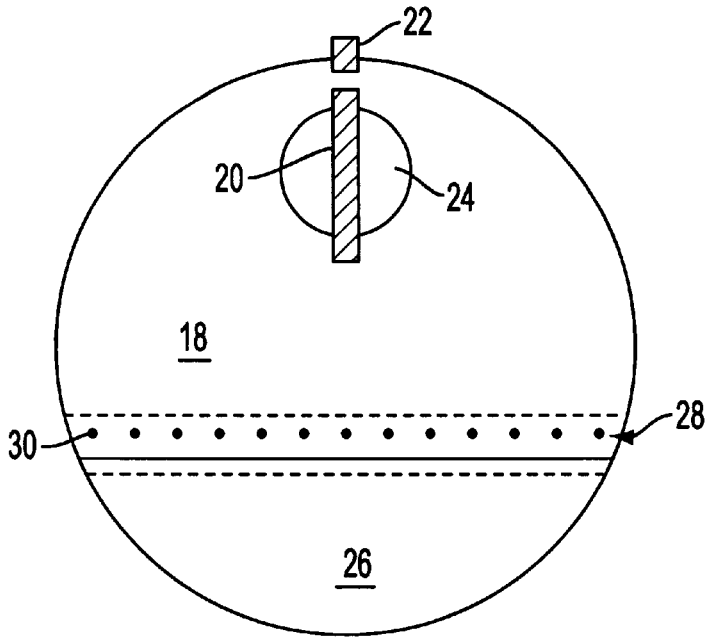
FIG. 2A depicts a perspective view of one end of a blast cabinet according to the present invention in which the door is engaged with a fixed endplate.

As shown in FIG. 2A, a door 18 is provided at one end of cylindrical housing 4, through which a workpiece can be passed in or out of the housing. The door can be provided at either end of the housing, but as shown in FIG. 1 and 2A is usually installed to the left of the user, who is usually right-handed. Left-handed models can be assembled as well. Thus, left end 21 is defined essentially by door 18, door handle 20 attached to door 18, and endplate 26, which partially covers end 21. The door is conveniently made from the lid of a drum, of the open-top style. A steel handle is available from Nielsen-Sessions (Hartford, Conn.). Preferably door 18 covers approximately the upper two-thirds of the end section.

Door 18 is contacted with the periphery of end 21 with pressing means 22, which is conveniently provided as a hook latch, threaded bolt, slot and peg, bolt and wingnut, and the like. A particularly preferred pressing means is a pull-down catch with spring hook available from Nielsen-Sessions. The base of the catch is welded to the outside of housing 4 near end 21 with the hook portion of the device extending therefrom. Thus, whenever the upper lip of door 18 is slipped under the hook portion, the hook portion can be made to press tight against the outside of the door by operation of a lever in the catch.

Hole 24 is also provided in door 18, through which compressed air injected inside the cabinet can be passively vented. The vent can be readily introduced in the door by using a knockout device. The vent can optionally be provided with an internal baffle (not shown) to prevent loss of abrasive media from the cabinet. Hole 24 can also serve as an entry port for clean air from outside the housing, such as when a vacuum is applied to the housing, as described herein.

Door 18 is also provided with a retaining means at its lower edge in order to retain it against endplate 26. As shown in FIG. 2A, the retaining means is preferably a metal strip 28 riveted along rivet line 30 to the inside of door 18 which contacts the inside of end-plate 26. Other retaining means can be used, however, such as slats, convex flange, and the like. Metal strip 28 is conveniently about three inches wide and extends the full length of the lower edge of door 18. Endplate 26 is preferably welded to the body of housing 4.

Figure 2B:
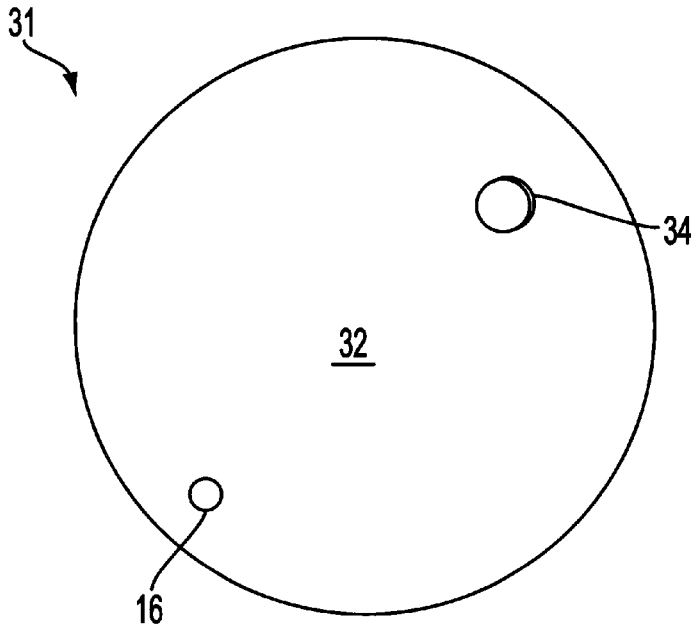
FIG. 2B depicts a perspective view of the opposing fixed end of the blast cabinet.

Opposing end 31 is depicted in FIG. 2B and is defined essentially by endplate 32, which is affixed to cylindrical housing 4, e.g., by welding. End-plate 32 is provided with compressed air inlet 16, and preferably is provided with vacuum port 34 which permits evacuating the interior of housing 4, as whenever it is desired to remove dust therein. Whenever a vacuum is applied to the interior of housing 4 through port 34, ambient air is drawn through vent 24 provided at the opposite end of the housing, thereby forcing air to flow laterally through the cabinet. A vacuum is conveniently established by attaching an external device, such as a SHOP-VAC.

Figure 3:
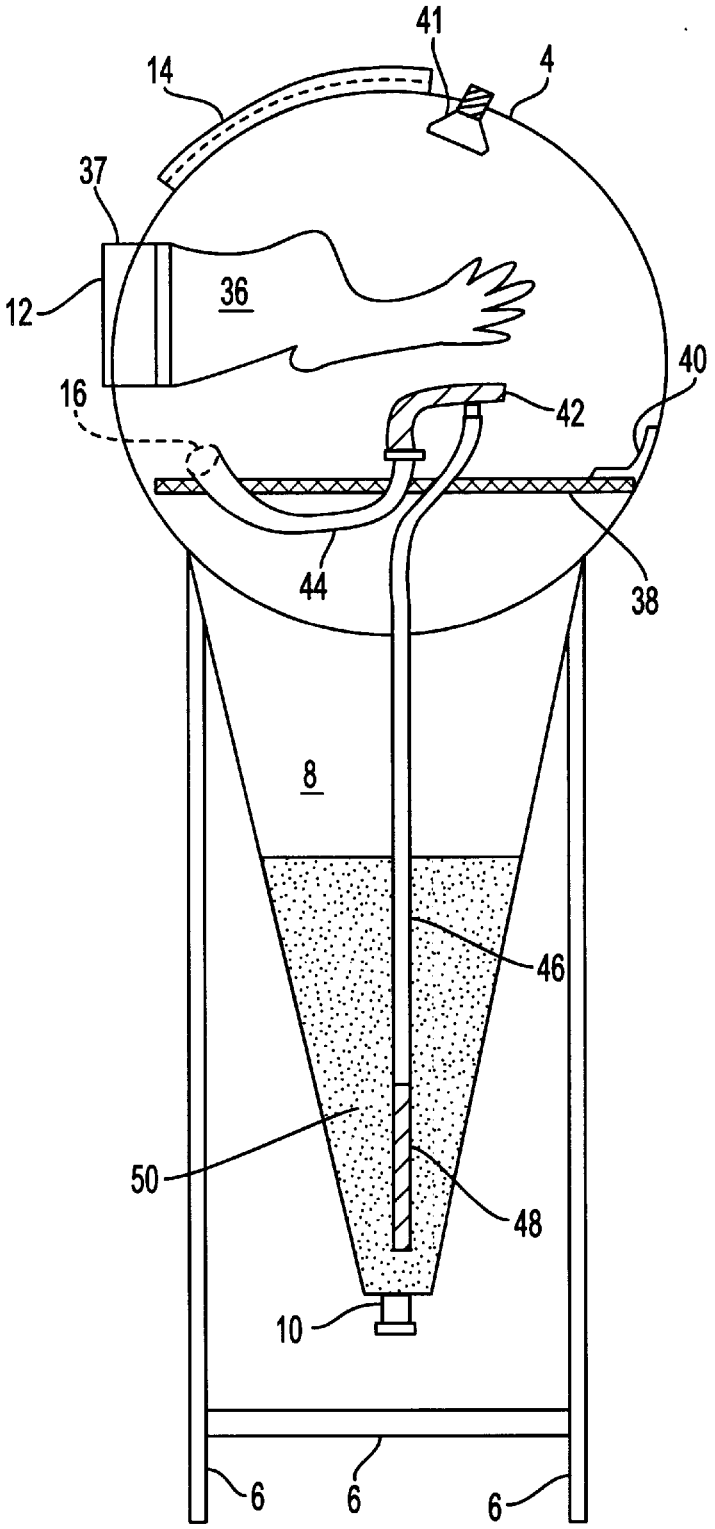
FIG. 3 depicts a cut-away view of the interior of a blast cabinet of the present invention.

An internal view of blasting cabinet 2 is depicted in FIG. 3, which shows the interior of housing 4 and the interior of hopper 8. As shown, rubber gloves 36 are preferably attached to armrests 37 provided in the sidewall of housing 4. Armrests 37 are conveniently made from a steel tube, e.g., a tube 6" in diameter, 2.2" in length, and having a ⅛" wall. The armrests are welded completely to housing 4 to fix them in place. The rubber gloves can be secured to the interior region of armrests 37 with a large hose clamp, and the like. The rubber gloves can-be obtained from Comasec.

Grate 38 is also provided interior the cylindrical housing for supporting a workpiece thereon. Preferably, grate 38 is hingeably attached to the interior of housing 4, so that the grate can be rotated upwards out of the user's way thereby enabling the user to retrieve a workpiece should it fall into hopper 8. This feature is illustrated in FIG. 3 as hinge 40, which is welded to the inside wall of housing 4. The grate is preferably about 30.5 inches long and about 17 inches wide.

Also shown in FIG. 3 is an optional aspect of the invention in which an electric light 41, e.g., a floodlight, is mounted on the inside of the sidewall of housing 4 in order to illuminate a workpiece therein. In this case, an electrical outlet is affixed to the interior of housing 4. Alternatively, the light can be affixed to the interior of endplate 32, depending on the preferred location of the light. An external switch 39 in communication with light 41 is shown in FIG. 1.

A blasting means is also typically provided for use inside a cabinet of the invention. As shown in FIG. 3, a blasting means is conveniently provided by nozzle 42, compressed air intake line 44, and abrasive siphon line 46, which is connected to a metal tube 48, welded to the inner wall of hopper 8. The siphon line is typically about 0.5 inch in diameter, and the metal tube 48 is conveniently about 10 inches in length. A stock of abrasive media 50 is deposited at the bottom of hopper 8 and covers the lower end of tube 48, and preferably fills about two-thirds of the hopper's capacity.

Whenever compressed air is passed through line 44 into nozzle 42, a vacuum is created in line 46, depending on the velocity of the gas passing through the nozzle. This vacuum draws particles of abrasive up through line 46 and out through nozzle 42. A suitable blast nozzle and associated hoses is commercially available from TiP (Canfield, Ohio).

Figure 4A:
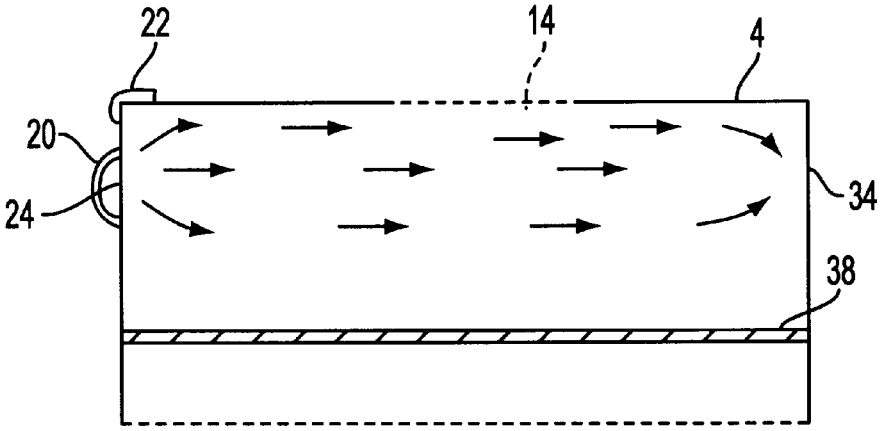
FIG. 4A depicts a cut-away view of the housing showing the lateral airflow through the housing.

As shown in FIG. 4A, the provision of port 24 in the door and vacuum vent 34 in the upper regions of their respective endplates permits establishing a strong lateral flow of air through the housing. The air flow pattern is illustrated and shows how clean air is continuously passed through the housing in proximity to window 14 so that the view area of the user is not obscured by dust generated by the abrasion process. The problem of dead air containing fine dust, and the need for periodic purging of the cabinet, is thereby avoided.

Figure 4B:
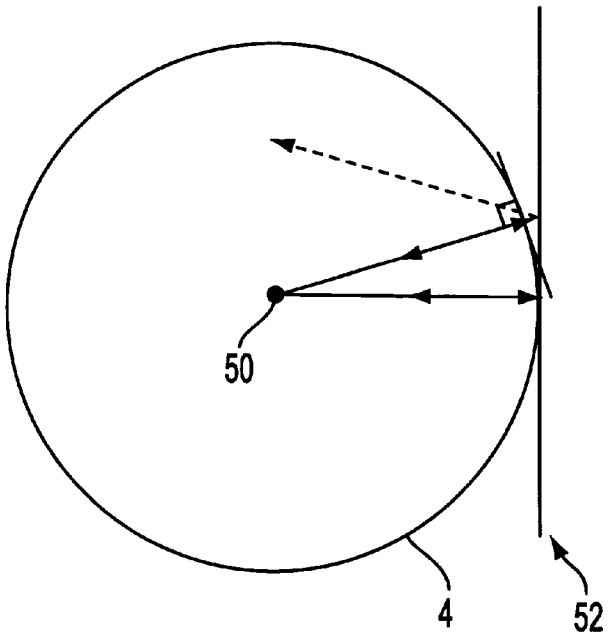
FIG. 4B depicts the reflection of abrasive particles back from the interior wall of the cylindrical housing toward the longitudinal axis as compared with a rectangular housing.

FIG. 4B shows another advantageous feature of the present invention, namely, the ability of the cylindrical housing 4 to reflect abrasive particles back toward the center of the housing. Thus, whenever the blasting means is positioned roughly along the central longitudinal axis 50 of the housing, blasting particles striking the housing wall are reflected back towards the axis. Also, the blasting means can be rotated laterally with the effect that particles are still reflected back toward the central axis (not shown). By way of comparison, the situation that occurs when a rectangular housing is used is shown by the phantom line, which depicts reflection of a particle from back panel 52. Hence, particle reflection in a rectangular housing can accentuate scratching of a window in the housing as well as obscure the vision of the user.

Exemplary abrasive media include sand, glass, alumina, ground walnut shells, and other generally inexpensive and hard materials.

A method of making a blasting cabinet is also contemplated. Such a method comprises providing a cylindrical drum, e.g., a 55 gallon drum, which has opposing endplates, one of which may be readily detachable. A lower section of the sidewall is removed, such as with a cutting torch, and a hopper is attached to the cylinder around the removed section, e.g., by welding. A portion of one of the endplates is removed from the drum so as to provide a door opening, and the removed section can be used to assemble a door as described herein. A view hole and armholes are also provided in the sidewall of the cylinder and a transparent window is attached. The window is preferably curved to conform to the shape of the cylinder.

Further alterations to the drum include providing a vent hole in the intact endplate and an air entry hole in the removed endplate section. These holes should be provided in the respective upper regions of the endplates so that airflow passes between them in proximity to the window.

A handle, a pressing means and a retaining means can also be attached to the door to permit its firm attachment to the housing. The pressing means is attached to the exterior of the housing and the retaining means is affixed to the interior of the door so that it will engage with the partial endplate. A grating can also be provided inside the housing for supporting a workpiece therein. It is also preferred to attach gloves to the armholes to ensure closure of the cabinet and prevent abrasion of the user's hands.

A method of using the present invention entails opening the door of the cabinet, placing a workpiece therein, and impinging a stream of abrasive particles against the workpiece so as to remove corrosion, rust, and the like. Preferably, a lateral flow of air is also established during operation so that dust generated upon abrasion is removed rather than permitted to accumulate. Once the workpiece is sufficiently cleaned, the airflow is stopped, the door is removed, and the cleaned workpiece is removed from the cabinet. Occasionally, the grating inside the housing is rotated up to permit access to parts and abrasive collected in the hopper.

The present invention has been described above with reference to particular preferred embodiments for purposes of clarity and understanding. It should be appreciated that certain obvious additions and modifications to the present invention can be practiced within the scope of the appended claims.

What is claimed is:

1. A cabinet for applying a dry abrasive under elevated pressure to a workpiece provided inside the cabinet comprising:

a horizontally arranged cylindrical housing having first and second ends and a curved sidewall, said housing having a longitudinal central axis extending horizontally through the interior of the housing, which curved sidewall is effective in reflecting abrasive particles toward said longitudinal axis;

a first end-plate affixed to and partially covering a lower portion of the first end and a door that covers an upper portion of the first end not covered by the first end-plate;

a second end-plate affixed to and completely covering the second end;

means for supporting the cylindrical housing;

hopper means affixed to a lower region of the sidewall of the housing and in communication with the interior of the housing;

openings provided in the sidewall of the cylindrical housing through which a user's hands can be inserted;

a curved transparent window provided in the curved sidewall of the housing, which window is arranged relative to said openings so as to permit a user to view a workpiece while manipulating the workpiece in the interior of the housing; and means for establishing lateral airflow in the interior of the housing and in proximity to the window, which is effective in removing dust generated inside the housing, said means comprising a hole provided in said door, which permits entry of air to the interior of the housing, and a vent hole provided in the second end-plate, which permits attachment of an external vacuum device.

2. The blasting cabinet of claim 1, further comprising a blasting means for ejecting pressurized abrasive inside the cabinet.

3. The cabinet of claim 2, wherein the blasting means draws abrasive from the hopper means under a vacuum and subjects the abrasive to elevated pressure, which pressurized abrasive can be directed to the workpiece by the user.

4. The cabinet of claim 2, wherein the blasting means is positioned in the interior of the housing permitting directing abrasive substantially normal to the interior sidewall of the housing.

5. The cabinet of claim 2, wherein the blasting means is positioned along the central longitudinal axis interior the housing.

6. The cabinet of claim 1, wherein said hopper means is frusto-conical or frusto-rectangulopyramidal in shape.

7. The blasting cabinet of claim 1, further comprising:

means for pressing against the outside of said door to press the door against the first end of the cylindrical housing; and retaining means that engages with the inside of said first end-plate.

8. The cabinet of claim 7, wherein said pressing means comprises a latch, and said retaining means provided on the door is a metal strip.

9. The cabinet of claim 1, further comprising a handle attached to the door.

10. The blasting cabinet of claim 1, further comprising a grate provided interior the cylindrical housing for supporting a workpiece thereon.

11. The cabinet of claim 10, wherein the grate is hingeably attached to the housing.

12. The cabinet of claim 1, further comprising an electrical outlet provided in said housing capable of supplying electrical current to a light inside the housing.

* * * * *